US006896936B2

(12) United States Patent
Neuhaus-Steinmetz et al.

(10) Patent No.: US 6,896,936 B2
(45) Date of Patent: May 24, 2005

(54) APPLICATION OF COATINGS TO SUBSTRATES WITH THE AID OF ELECTROSTATIC CHARGES

(75) Inventors: Hermann Neuhaus-Steinmetz, Ahrensburg (DE); Lars Guldbrandsen, Hamburg (DE); Maren Klose, Seevetal (DE)

(73) Assignee: tesa AG, Hamburg (DE)

( * ) Notice: Subject to any disclaimer, the term of this patent is extended or adjusted under 35 U.S.C. 154(b) by 9 days.

(21) Appl. No.: 10/291,944

(22) Filed: Nov. 11, 2002

(65) Prior Publication Data

US 2003/0138572 A1 Jul. 24, 2003

(30) Foreign Application Priority Data

Nov. 26, 2001 (DE) ..... 101 57 881

(51) Int. Cl.[7] ..... B05D 1/04; B05D 1/26

(52) U.S. Cl. ..... 427/482; 427/483; 427/485; 427/207.1; 427/420

(58) Field of Search ..... 427/458, 482, 427/483, 485, 207.1, 208.2, 208.4, 420

(56) References Cited

U.S. PATENT DOCUMENTS

| | | | | | |
|---|---|---|---|---|---|
| 4,339,485 | A | * | 7/1982 | Shibano et al. | 428/40 |
| 4,457,256 | A | * | 7/1984 | Kisler et al. | 118/621 |
| 4,517,143 | A | * | 5/1985 | Kisler | 264/484 |
| 4,622,260 | A | | 11/1986 | Tesch | 428/173 |
| 4,791,004 | A | * | 12/1988 | Suzuki et al. | 427/541 |
| 4,997,600 | A | | 3/1991 | Okumura et al. | 264/22 |
| 5,340,616 | A | * | 8/1994 | Amano et al. | 427/458 |
| 6,120,278 | A | | 9/2000 | Zimmermann et al. | 428/174.8 E |

FOREIGN PATENT DOCUMENTS

| | | | | |
|---|---|---|---|---|
| DE | 43 13 008 | C1 | 11/1994 | C09J/133/06 |
| DE | 199 05 935 | A1 | 8/2000 | B05D/5/10 |
| EP | 071 212 | B1 | 7/1982 | D04H/13/00 |
| EP | 0299 492 | A2 | 7/1988 | B05D/1/04 |
| EP | 0 578 151 | A1 | 7/1993 | C09J/133/08 |
| EP | 0 707 940 | A2 | 4/1996 | B29C/47/88 |
| EP | 0 920 973 | A2 | 6/1999 | B29C/47/88 |
| WO | 92/12612 | * | 7/1992 | |

OTHER PUBLICATIONS

Abstract of English language counterpart of EP 0 578 151 A1.

* cited by examiner

*Primary Examiner*—Fred J. Parker
(74) *Attorney, Agent, or Firm*—Norris McLaughlin & Marcus PA

(57) ABSTRACT

A process for producing products in web form comprising at least two layers, in which a composition emerging from an applicator is applied as a layer to a substrate in web form which is guided on a transport means, said application taking place with application of electrostatic charges, and in which the substrate coated with the composition is electrostatically neutralized before departing the transport means, electrostatic charges being applied to the web-formed substrate prior to coating, by means of a substrate electrode, so that the substrate is pressed onto the transport means.

25 Claims, 2 Drawing Sheets

APPLICATION OF COATINGS TO SUBSTRATES WITH THE AID OF ELECTROSTATIC CHARGES

The invention relates to a process for producing products in web form comprising at least two layers, especially adhesive tapes with a carrier material atop which an adhesive has been applied.

BACKGROUND OF THE INVENTION

Work has long been ongoing on producing adhesive tapes without using solvents or at least on designing the coating operation and the downstream steps to be solvent-free. Corresponding products with films of adhesive based on synthetic rubbers are known. These products, however, cover only the lower-end performance range of adhesive tapes.

For a number of years it has also been possible to obtain solvent-free adhesives based on acrylate, which can be processed further as hotmelt adhesives for adhesive tapes. Normally, however, they do not match the shear strengths of acrylate compositions applied from solution. One important reason for this is that the viscosity of the compositions during processing must not become too high, since otherwise the operations of melting and of coating onto a carrier are too expensive from the economic standpoint. The viscosity is determined substantially by the length of the molecules. Relatively short chain molecules, however, result in poorer shear strengths. Even crosslinking of the adhesive following its application permits only limited improvement.

In the case of natural rubber adhesive systems, the melting operation can be avoided if success is achieved in mixing the components of the composition without solvent and if the hot composition is supplied directly to a coating system. Examples of suitable mixing units include extruders. In the course of mixing, however, the rubber must not be degraded any more than slightly, since otherwise the product properties are impaired.

In the case of acrylate systems, the melting operation can be avoided by removing the solvent or water from compositions polymerized in solvents or in water, the removal taking place inline for the purpose of coating. In an appropriate extruder, for example, solvents or water can be removed by way of vacuum zones.

For the application of high-viscosity compositions, slot dies are suitable. It is found that they are also suitable for high-viscosity adhering compositions as described above. However, above a relatively low web speed, air bubbles become included between the adhesive and the substrate, which is typically coated on a coating roller.

In order to reduce the formation of bubbles in the above task, the market recommends blowing dies, suction dies, and what are known as vacuum boxes. The aim of using these devices is to raise the force with which the composition is pressed against the substrate.

Known from film manufacture (for example, EP 0 920 973 A2) are wire, blade, and needle electrodes, disposed transverse to the web, with which electrical charges are applied to the composition that is to be laid on. By this means the composition is pressed by electrostatic forces against a metal roller. Furthermore, combinations of electrostatic forces and forces by air movement are also used (EP 0 707 940 A2).

For the above-described coating of substrates, the literature reports complex solutions, in which before being laid onto the chill roll the substrate is charged in multistage upstream processes, partially discharged by heating, and cooled, in order finally to obtain uniform charging of the substrate on the coating roller (for example, EP 0 299 492 A2).

The maximum level of charge on the substrate in these cases, however, is relatively low, since as early as on leaving the charging roller it is reduced until the air is no longer ionized, owing to the electrical field strength resulting from the charge density.

From film manufacture (see, for example, U.S. Pat. No. 4,997,600 A1) a roller insulation system is known in which prior to the laying-on of the film electrical charges are applied to the insulator layer in order to increase the forces of applied pressure when the film is laid onto the roller.

If no charges are applied to the insulated roller, the electrostatic forces applying pressure during the laying-on operation are greatly attenuated as the thickness of the insulator layer goes up. At the required insulator thicknesses needed for sufficient high-voltage resistance for the ceramic coatings specified here, achievable bubble-free coating speeds are drastically reduced.

DE 199 05 935 Al discloses a method of producing a coating of solvent-free pressure sensitive adhesive systems on substrates, especially release-coated substrates, in which

- the pressure sensitive adhesive system is applied in one or more layers to a rotating roller by means of an adhesive applicator,
- the pressure sensitive adhesive system on the roller is crosslinked in an exposure means by high-energy radiation, specifically by means of electron beams (EB), UV or IR radiation, and
- the roller is contacted with the substrate, so that the pressure sensitive adhesive system is transferred from the roller to the substrate, and where appropriate is rolled up.

Typical exposure means employed in the context of the embodiment of the method that is depicted in said patent include linear cathode systems, scanner systems, and multiple longitudinal cathode systems, where electron beam accelerators are concerned. The acceleration voltages are situated in the range between 40 kV and 350 kV, preferably from 80 kV to 300 kV. The output doses range between 5 and 150 kGy, in particular from 20 to 90 kGy.

As UV crosslinking units it is possible in particular to employ two medium pressure mercury lamps each with an output of 120 W/cm or one medium pressure mercury lamp having an output of 240 W/cm. The doses set are preferably from 10 to 300 mJ/cm$^2$.

DE 199 05 935 A1 describes a method of producing a coating of solvent-free pressure sensitive adhesive systems on substrates, especially release-coated substrates, in which

- a fluid film is applied to a rotating roller by means of a fluid applicator,
- the pressure sensitive adhesive system is applied in one or more layers to the fluid film by means of an adhesive applicator, so that the fluid film is located between roller and pressure sensitive adhesive system, and
- the roller is contacted with the substrate, so that the pressure sensitive adhesive system is transferred from the roller to the substrate (release-coated or otherwise).

The contacting of the substrate takes place in particular by way of a second roller. Substrates used include papers, films, nonwovens, and release-coated materials such as release papers, films, and the like.

The second roller, also referred to as a contact roller, may have been provided with a rubber coating and is pressed against the roller with a linear pressure of preferably 50 to 500 N/mm, in particular from 100 to 200 N/mm. The contact roller preferably has a Shore hardness (A) of from 40 to 100, in particular a Shore hardness of from 60 to 80 shore (A). The substrate is preferably brought into contact with the roller in such a way that the speed of the roller surface coincides with that of the substrate. Where, however, it is intended that a reduction in thickness should take place along with the removal of the adhesive film, the substrate may also have a higher speed.

In one advantageous embodiment the roller is a steel roller, a chrome-plated steel roller, a rubber roller or a silicone rubber roller and/or is manufactured from elastic material. Furthermore, the roller may be smooth or may have a slightly structured surface. The smooth roller may preferably have a chrome coating. Optionally, the chrome-coated steel roller may possess a high-gloss-polished surface with a roughness $R_z<0.02$ $\mu$m. The coating roller may also, however, be rubberized, preferably with a rubber hardness of from 40 to 100 shore (A), in particular with a hardness of from 60 to 80 shore (A). The roller coating may, in accordance with the prior art, comprise EPDM, Viton or silicone rubber, or other elastic materials.

It has also proven advantageous for the roller to be temperature-controllable, preferably in a range from −10° C. to 200° C., particularly from 2° C. to 50° C.

It is an object of the invention to allow the substrate to be coated with compositions, especially compositions of high viscosity, such as are used for producing adhesive tapes or similar products, with the preferred use of a slot die, with sufficiently high web speeds. In the course of this operation, there should be

- no bubbles included between the composition coat and the substrate,
- no detriment to quality-critical properties of the product being produced, and
- no hazards arising for operating staff.

This object is achieved by means of a process as specified in the main claim. The subclaims describe advantageous embodiments of the process.

SUMMARY OF THE INVENTION

The invention accordingly provides a process for producing products in web form having at least two layers, in which a composition emerging from an application means is applied to a substrate in web form which is guided on a transport means, said application taking place with application of electrostatic charges, and in which the substrate coated with the composition is electrostatically neutralized before departing the transport means, with electrostatic charges being applied to the web-form substrate prior to coating, by means of a substrate electrode, so that the substrate is pressed onto the transport means.

DETAILED DESCRIPTION OF THE INVENTION

In a first preferred embodiment of the process the application means is configured as a die, particularly a slot die, double-manifold or multiple-manifold die or adapter die.

The substrate web on the transport means is coated, preferably contactlessly, with the composition emerging from the die. The distance of the die from the substrate web on the transport means may be preferably from 0.01 to 60 mm, in particular from 1 to 30 mm.

With further preference, the transport means is designed as a coating roller, which additionally, in particular, is of a grounded and/or temperature-controllable design, and preferably in a range from −10° C. to 200° C., very particularly preferably in a range from 0° C. to 180° C., particularly from 2° C. to 50° C.

In order to be able to provide the composition with the charge according to the invention, the composition may be charged electrostatically by means of at least one charging electrode, called lay-on electrode in the following, which is located in particular above the transport means, preferably coating roller, and specifically in the region of the coating line of the composition coat. The coat is pressed onto the substrate with the aid of the charges.

With the lay-on electrode, charges are applied to one side of the composition. On the surface of the transport means, preferably coating roller, countercharges come about immediately. The resulting field causes a force to act on the composition plus substrate, which presses both coats onto the transport means, preferably coating roller.

Moreover, in one outstanding embodiment of the inventive concept, the substrate coated with the composition is electrostatically neutralized by means of at least one countercharging electrode prior to departing the transport means, preferably coating roller, said countercharging electrode very particularly being located over the transport means, preferably coating roller, in the region between the coating line of the composition coat and the take-off line of the coated substrate.

Accordingly, electrostatic discharges as a consequence of applying charges by the lay-on electrode can be prevented even before the coated substrate has departed the preferred coating roller, by applying countercharges of opposite polarity and appropriate size.

For fine tuning it is further advantageous to mount an active discharge means over the detachment line of the coated substrate from the preferred coating roller, in order to compensate process-related fluctuations over time and across the width of the web.

The countercharging electrode is preferably in the form of a wire electrode, blade electrode and/or needle electrode which is disposed transverse to the web.

Without adequate neutralization of the electrical charges applied to the web by the lay-on electrode(s), there may be a corona discharge between the coating roller and the underside of the substrate, which may adversely affect, in particular, anti-adhesive properties of the substrate.

Additionally, as a result of the corona discharge, charges of opposed polarity may be transported on the underside of the web as on the coating side. If such as web is subsequently neutralized with customary active or passive discharge means, the measurable electrical field is eliminated but afterward there are still very strong, equally high charges of opposed polarity on the two sides. If the electrical conductivity of the coats between the charges is low, there may be uncontrollable discharges in bales that have been wound up.

In order to subject the substrate to as little stress as possible, the substrate should then be placed onto the transport means, preferably coating roller, with a contact roller and/or removed from the transport means, preferably coating roller, with a take-off roller.

It is advantageous, additionally, to use a roller with a conductive elastic coating as the preferred contact roller with which the substrate is placed onto the preferably selected coating roller. Where a conductive coating cannot be used for technical reasons associated with the process, it is advantageous to subject the roller jacket to electrostatic discharge in a region in which it is not covered by the substrate. Otherwise, with each turn the roller surface may pick up more and more electrical charges, until uncontrolled discharge phenomena occur.

It is also advantageous to dispose a baffle of electrically insulating material in the running direction of the web upstream of the lay-on electrode, thereby limiting the ion-enriched area in the region of the lay-on electrode on the die side. It is favorable, in addition, to mount a grounded, electrically conducting metal plate on the side of the baffle that faces away from the lay-on electrode. By means of the baffle, any corona discharge upstream of the coating line can be reduced markedly by the composition coat on the substrate.

Also of advantage is an arrangement in which not only one needle electrode is used as lay-on electrode but instead two, directly following one another in the web direction, the two electrodes being offset laterally by a distance equal to half the distance between the needles on the needle electrodes, thereby pairing the capacity of the needle electrodes for high charging currents with a relatively uniform charge distribution. In this context it has been found advantageous to impose a smaller high voltage on the front electrode than on the rear electrode.

In another preferred embodiment of the invention, the substrate is electrostatically neutralized prior to coating.

In order to rule out further the known disadvantages of the prior art, the electrical voltage of the transport means, preferably coating roller, can be from 1 to 40 kV, in particular from 2 to 15 kV.

In another preferred variant of the process of the invention, the composition on the substrate is crosslinked or polymerized before departing the transport means, preferably coating roller, in particular by means of electron beams, UV rays, visible light or a combination thereof and/or thermally.

In another preferred embodiment of the invention, the substrate electrode is formed by a plurality of electrodes, preferably needle, blade or wire electrodes, which are arranged in series.

With further preference, the substrate electrode is arranged between the contact roller and the application means.

It is very advantageous to arrange the substrate electrode instead of a contact roller in the region over the coating line of the substrate onto the transport means, preferably coating roller.

Finally, the substrate electrode may advantageously be charged with an electrical voltage of the opposite polarity to the lay-on electrode, the level of the voltage to be applied being able to be chosen independently of the level of the voltage at the lay-on electrode.

It is also advantageous if the transport means is provided with an electrically insulating coating.

In another preferred embodiment of the process, the thickness of the coating is less than 300 $\mu$m, in particular between 20 and 200 $\mu$m, with very particular preference between 20 and 120 $\mu$m, and/or deviates preferably by not more than ±20%, in particular not more than ±5%, from the average over the entire substrate-contacting surface of the transport means.

It is also very advantageous if the coating is not very rough and/or has antiadhesive properties.

It is particularly advantageous to effect electrostatic neutralization of the coating in a region in which it is not covered by the substrate. Otherwise, with each turn, the coating may pick up more and more electrical charge, until uncontrolled discharge phenomena occur. However, even relatively small uncontrolled chargings, especially if they are not uniform, have an adverse effect on the formation of bubbles between coating and substrate.

In one outstanding embodiment the coating is composed of polyester, Teflon® fluorocarbon polymer, Kapton® fluorocarbon coated polyamide, silicone rubber, polypropylene, casting resin or other materials having sufficient high-voltage resistance at low layer thickness.

By way of example, the coating used can be a shrink sleeve which is pulled over the transport means, especially a coating roller, and shrunk.

In addition, an insulator-coated, electrically conductive sleeve which is pulled over the transport means, especially coating roller, is outstandingly suitable.

In one preferred variant of the process the coating is applied in excess, is optionally cured, is subsequently, further, ablated to a desired, very constant, layer thickness, and finally is polished for low roughness.

Possible embodiments of the coating that may be mentioned by way of example include PET films varying in thickness, and also applications of casting resin, preferably with thicknesses between 20 $\mu$m and 300 $\mu$m, in particular with thicknesses between 20 $\mu$m and 120 $\mu$m.

Another preferred variant constitutes an electrically conductive conveyor belt which is coated with an electrical insulator and on which, for the purpose of coating, the substrate is guided over a coating roller, the coating preferably having thicknesses of between 20 $\mu$m and 300 $\mu$m and being able in particular to have thicknesses between 20 $\mu$m and 120 $\mu$m.

Another preferred variant is a thin conveyor belt comprising an electrical insulator, preferably with thicknesses of between 20 $\mu$m and 300 $\mu$m and in particular with thicknesses of between 20 $\mu$m and 120 $\mu$m, on which, for the purpose of coating, the substrate is guided over a coating roller.

A further preferred variant is a modification in which an auxiliary sheet, which after unwinding from a bale is brought between the electrically conductive transport means and the substrate, is wound up again to a bale after the coating substrate has been removed from the auxiliary sheet.

The process can be used to outstanding effect in those applications where the substrate is a carrier or backing material for an adhesive tape and/or the composition is an adhesive.

In this case the composition used may also comprise acrylic, natural rubber, synthetic rubber or EVA adhesives.

The process can likewise be used to outstanding effect in those applications where the substrate is a release liner for an adhesive tape and the composition is an adhesive.

The process can likewise be employed to outstanding effect in those applications where the substrate is a semi-finished product composed of release liner, adhesive, and carrier or a double-sided adhesive tape and the composition is an adhesive.

Furthermore, it is found that the tendency to form bubbles between the composition and the substrate increases if the substrate has become charged in an uncontrolled manner prior to placement onto the coating roller. It is also a problem if electrostatic discharge means are not mounted on the side of the web on which charging can take place as a result of separation events. In this case as well, no electrical field is measured any longer from the outside, but nevertheless there are equally strong electrical charges of opposed polarity on both sides of the web. The level of these double charges typically fluctuates in the web direction and also transversely to the web. These undefined double charges reduce the maximum speed at which the web can be effectively and safely run in a production process.

In one advantageous embodiment, discharge means are always mounted on the side at which charges occur as a result of separation events. With electrostatically difficult substrates, it may in extreme cases be of advantage to mount suitable discharge means behind each deflecting roller on the contact side and even in the winding nip at the unwind stage.

Moreover, it is advantageous to run the supplied bales with the substrate under electrostatic control as early as in the upstream process, or to select a sufficiently long interim storage period, due to sufficient electrical residual conductivities, for double charges to flow together. The time required may also be shortened by means of storage at elevated temperatures.

It is particularly advantageous to mount a baffle made of electrically insulating material in the running direction of the web between the applicator and the lay-on electrode, thereby bordering the ion-filled area in the region of the lay-on electrode by the applicator, especially die, the transport means, especially coating roller, and the baffle.

The coating as well may be composed of one or more layers and/or the substrate may be composed of one or more layers, it being advantageous to produce multilayer coatings using multiple-manifold dies or adapter dies.

It is also very advantageous if by means of adapters in the case of a single-manifold die or using a triple-manifold die a coating is applied which is composed of a first adhesive, a carrier, and a second adhesive, and the substrate is a release liner.

Unexpectedly for the skilled worker, the inventive process offers a solution to the problems posed. Thus, coating with a slot die onto a substrate at sufficiently high web speeds is made possible without the development of bubbles between the composition coat and the substrate, without adverse effects on other, quality-critical properties of the product to be produced, and without special risks to the operating staff.

Surprisingly it has been found that bubbles are formed between the composition coat and the substrate particularly when there is air between the substrate and the coating roller. If the substrate was placed onto the coating roller in a bubble-free manner, it was possible to carry out coating with a higher web speed without the formation of bubbles. The appearance of the coating is much more uniform than in the case of a coating operation in which the substrate was not placed bubble-free on the coating roller during the production process.

Particularly when laying on sensitive substrates which can only be run at low work tensions using a contact roller, lifting of the substrate directly downstream of the rollers occurs very readily, so that again there is a layer of air between substrate and transport means.

Particularly effective wetting of the transport means, preferably roller, with the substrate with low levels of air inclusion can be achieved if the substrate is pressed on with a substrate electrode, instead of a contact roller, in the region above the coating line of the substrate. Effective wetting, in other words almost complete expressing of the air, is further promoted by a very smooth roller surface.

Additionally it has also been found that an antiadhesive release layer on the side facing the transport means is damaged to a lesser degree by the charging and discharging processes if the wetting on the transport means is better.

The gas space (volume of the bubbles between substrate and transport means in the region of charging electrodes) which exists, and in which ionization which is harmful for the release layer, especially as a result of the high electrical fields of the composition electrode, can take place, reduces in proportion with the quality of the wetting of the transport means, preferably coating roller.

Moreover, it is possible to ascertain, unexpectedly, that the formation of bubbles between the composition coat and the substrate is greatly reduced if the substrate is electrostatically neutralized in the web region upstream of the coating roller, very preferably on the side at which a charge accumulation occurs as a result of charge separation events.

With further preference, the substrate present on the transport means can be crosslinked, between the lay-on electrode and discharge electrode, by means of high-energy radiation supplied by an irradiation means, specifically by means of electron beams (EB), UV or IR rays. This is especially advantageous when the substrate in question is an adhesive.

Typical exposure means employed in the context of the inventive embodiment of the process are linear cathode systems, scanner systems, or multiple longitudinal cathode systems, where electron beam accelerators are concerned.

The acceleration voltages are situated preferably in the range between 40 kV and 500 kV, in particular between 80 kV and 300 kV. The output doses range between 5 and 150 kGy, in particular from 15 to 90 kGy.

As UV crosslinking units it is possible in particular to employ one or more medium pressure mercury lamps each with an output of up to 240 W/cm per lamp. The doses set are preferably from 10 to 300 mJ/cm$^2$.

For crosslinking or polymerization with visible light, halogen lamps may be employed in particular.

As substrate it is also possible to use release liners with anti-adhesive coatings to which the adhesion of adhesives is low. The backing materials of release liners are typically composed of paper or plastics, such as PET, PP or else PE, for example. The plastics used generally have good electrical insulation properties and high electrical breakdown field strengths.

In the case of papers, in contrast, the electrical properties are determined substantially by the thin anti-adhesive coating, but also by the impregnation and the moisture content. When the composition is applied with assistance by electrostatic charging, greater importance attaches to the electrical properties of the applied composition. Although the compositions employed are usually electrical insulators, their residual conductivity at typical coating temperatures of 100° C. or more is often already sufficiently high for some of the applied charges to flow off through the composition and through the paper release liner into the coating roller before departing the roller. Since at the coating line, if the electrical conductivity is not too high, virtually all of the charge is still present on the composition coat, it is nevertheless possible to achieve sufficiently high pressing forces for bubble-free coating. In the subsequent electrical neutralization by the application of countercharges, however, it must be borne in mind that some of the charge has already flowed off. At low web speeds, the time available for the charges to flow off becomes greater, and proportionally more charge flows off before the detachment line is reached. The optimum level of the countercharges is therefore dependent on the web speed.

For reasons of both economics and processing, the release coatings used for release liners are as thin as possible. Use is also made of what have been dubbed "substituted-covering coatings". By this is meant that the carrier is not hidden 100% by the release coating. It has been found that neutralization of the coated substrate in the case of such release liners must be carried out with substantially greater precision than is the case, say, with PET or PP films with fully hiding silicone coatings of 1.5 g/m$^2$ or more.

In the cases of double-sided adhesive tapes, a distinction is made between the open side and the hidden side of the release liner. The hidden side of the release liner, after being unwound from the roll, is covered with the assembly comprising first adhesive film, carrier, and second adhesive film. For undisrupted further processing after coating and until application, the release forces from the adhesive on the open side should be less than or equal to, and at least not substantially greater than, release forces on the hidden side, since otherwise there may be a reorientation of the release liner to the other side.

Graded release liners are also available. With these, it can be insured that the hidden side has much higher release forces.

In the case of non-graded release liners, in particular, damage to the open side when producing a double-sided adhesive tape must only be relatively low, since the desire is to avoid replacement by an undamaged release liner.

For the production of double-sided adhesive tapes, the substrate may also be composed of the initial product from the first operation, namely of a release liner, an adhesive film, and the carrier.

As substrate or carrier material it is possible to use all known textile carriers such as wovens, knits, lays or nonwoven webs; the term "web" embraces at least textile sheetlike structures in accordance with EN 29092 (1988) and also stitchbonded nonwovens and similar systems.

It is likewise possible to use spacer fabrics, including wovens and knits, with lamination. Spacer fabrics of this kind are disclosed in EP 0 071 212 B1. Spacer fabrics are matlike layer structures comprising a cover layer of a fiber or filament fleece, an underlayer and individual retaining fibers or bundles of such fibers between these layers, said fibers being distributed over the area of the layer structure, being needled through the particle layer, and joining the cover layer and the underlayer to one another. As an additional though not mandatory feature, the retaining fibers in accordance with EP 0 071 212 B1 comprise inert mineral particles, such as sand, gravel or the like, for example.

The holding fibers needled through the particle layer hold the cover layer and the underlayer at a distance from one another and are joined to the cover layer and the underlayer.

Spacer wovens or spacer knits are described, inter alia, in two articles, namely an article from the journal kettenwirk-praxis 3/93, 1993, pages 59 to 63, "Raschelgewirkte Abstandsgewirke" [Raschel-knitted spacer knits] and an article from the journal kettenwirk-praxis 1/94, 1994, pages 73 to 76, "Raschelgewirkte Abstandsgewirke", the content of said articles being included here by reference and being part of this disclosure and invention.

Knitted fabrics are produced from one or more threads or thread systems by intermeshing (interlooping), in contrast to woven fabrics, which are produced by intersecting two thread systems (warp and weft threads), and nonwovens (bonded fiber fabrics), where a loose fiber web is consolidated by heat, needling or stitching or by means of water jets.

Knitted fabrics can be divided into weft knits, in which the threads run in transverse direction through the textile, and warp knits, where the threads run lengthwise through the textile. As a result of their mesh structure, knitted fabrics are fundamentally pliant, conforming textiles, since the meshes are able to stretch lengthways and widthways, and have a tendency to return to their original position. In high-grade material, they are very robust.

Suitable nonwovens include, in particular, consolidated staple fiber webs, but also filament webs, meltblown webs, and spunbonded webs, which generally require additional consolidation. Known consolidation methods for webs are mechanical, thermal, and chemical consolidation. Whereas with mechanical consolidations the fibers can be held together purely mechanically by entanglement of the individual fibers, by the interlooping of fiber bundles or by the stitching-in of additional threads, it is possible by thermal and by chemical techniques to obtain adhesive (with binder) or cohesive (binderless) fiber-fiber bonds. Given appropriate formulation and an appropriate process regime, these bonds may be restricted exclusively, or at least predominantly, to the fiber nodal points, so that a stable, three-dimensional network is formed while retaining the loose open structure in the web.

Webs which have proven particularly advantageous are those consolidated in particular by overstitching with separate threads or by interlooping.

Consolidated webs of this kind are produced, for example, on stitchbonding machines of the "Malifleece" type from the company Karl Meyer, formerly Malimo, and can be obtained, inter alia, from the companies Naue Fasertechnik and Techtex GmbH. A Malifleece is characterized in that a cross-laid web is consolidated by the formation of loops from fibers of the web.

The carrier used may also be a web of the Kunit or Multiknit type. A Kunit web is characterized in that it originates from the processing of a longitudinally oriented fiber web to form a sheetlike structure which has the heads and legs of loops on one side and, on the other, loop feet or pile fiber folds, but possesses neither threads nor prefabricated sheetlike structures. A web of this kind has been produced, inter alia, for many years, for example on stitchbonding machines of the "Kunitvlies" type from the company Karl Mayer. A further characterizing feature of this web is that, as a longitudinal-fiber web, it is able to absorb high tensile forces in the longitudinal direction. The characteristic feature of a Multiknit web relative to the Kunit is that the web is consolidated on both the top and bottom sides by virtue of the double-sided needle punching.

Finally, stitchbonded webs are also suitable as an intermediate forming an adhesive tape. A stitchbonded web is formed from a nonwoven material having a large number of stitches extending parallel to one another. These stitches are brought about by the incorporation, by stitching or knitting, of continuous textile threads. For this type of web, stitchbonding machines of the "Maliwatt" type from the company Karl Mayer, formerly Malimo, are known.

Also particularly advantageous is a staple fiber web which is mechanically preconsolidated in the first step or is a wet-laid web laid hydrodynamically, in which between 2% and 50% of the web fibers are fusible fibers, in particular between 5% and 40% of the fibers of the web.

A web of this kind is characterized in that the fibers are laid wet or, for example, a staple fiber web is preconsolidated by the formation of loops from fibers of the web or by needling, stitching or air-jet and/or water-jet treatment.

In a second step, thermofixing takes place, with the strength of the web being increased again by the (partial) melting of the fusible fibers.

The web carrier may also be consolidated without binders, by means for example of hot embossing with structured rollers, with properties such as strength, thickness, density, flexibility, and the like being controllable via the pressure, temperature, residence time, and embossing geometry.

For the use of nonwovens, the adhesive consolidation of mechanically preconsolidated or wet-laid webs is of particular interest, it being possible for said consolidation to take place by way of the addition of binder in solid, liquid, foamed or pastelike form. A great diversity of theoretical embodiments is possible: for example, solid binders as powders for trickling in; as a sheet or as a mesh, or in the form of binding fibers. Liquid binders may be applied as solutions in water or organic solvent or as a dispersion. For adhesive consolidation, binder dispersions are predominantly chosen: thermosets in the form of phenolic or melamine resin dispersions, elastomers as dispersions of natural or synthetic rubbers, or, usually, dispersions of thermoplastics such as acrylates, vinyl acetates, polyurethanes, styrene-butadiene systems, PVC, and the like, and also copolymers thereof. Normally, the dispersions are anionically or nonionically stabilized, although in certain cases cationic dispersions may also be of advantage.

The binder may be applied in a manner which is in accordance with the prior art and for which it is possible to consult, for example, standard works of coating or of nonwoven technology such as "Vliesstoffe" (Georg Thieme Verlag, Stuttgart, 1982) or "Textiltechnik-Vliesstofferzeugung" (Arbeitgeberkreis Gesamttextil, Eschborn, 1996).

For mechanically preconsolidated webs which already possess sufficient composite strength, the single-sided spray application of a binder is appropriate for effecting specific changes in the surface properties.

Such a procedure is not only sparing in its use of binder but also greatly reduces the energy requirement for drying. Since no squeeze rollers are required and the dispersion remains predominantly in the upper region of the web material, unwanted hardening and stiffening of the web can very largely be avoided.

For sufficient adhesive consolidation of the web carrier, the addition of binder in the order of magnitude of from 1% to 50%, in particular from 3% to 20%, based on the weight of fiber web, is generally required.

The binder may be added as early as during the manufacture of the web, in the course of mechanical preconsolidation, or else in a separate process step, which may be carried out in-line or off-line. Following the addition of the binder it is necessary temporarily to generate a condition in which the binder becomes adhesive and adhesively connects the fibers—this may be achieved during the drying, for example, of dispersions, or else by heating, with further possibilities for variation existing by way of areal or partial application of pressure. The binder may be activated in known drying tunnels, or else, given an appropriate selection of binder, by means of infrared radiation, UV radiation, ultrasound, high-frequency radiation or the like. For the subsequent end use it is sensible, although not absolutely necessary, for the binder to have lost its tack following the end of the web production process. It is advantageous that, as a result of the thermal treatment, volatile components such as fiber assistants are removed, giving a web having favorable fogging values so that when a low-fogging adhesive is used it is possible to produce an adhesive tape having particularly advantageous fogging values.

A further, special form of adhesive consolidation consists in activating the binder by incipient dissolution or swelling. In this case it is also possible in principle for the fibers themselves, or admixed special fibers, to take over the function of the binder. Since, however, such solvents are objectionable on environmental grounds, and/or are problematic in their handling, for the majority of polymeric fibers, this process is not often employed.

Starting materials envisaged for the textile carrier include, in particular, polyester, polypropylene, viscose or cotton fibers. The selection is, however, not restricted to said materials; rather it is possible to use a large number of other fibers to produce the web, this being evident to the skilled worker without any need for inventive activity.

Carrier materials used further include, in particular, laminates and nets, and also films (for example, a polyolefin from the group of the polyethylenes (for example, HDPE, LDPE, MDPE, LLDPE, VLLDPE, copolymers of ethylene with polar comonomers) and/or the group of the polypropylenes (for example, polypropylene homopolymers, random polypropylene copolymers or block polypropylene copolymers), monoaxially or biaxially oriented polypropylene, polyesters, PVC, PET, polystyrene, polyamide or polyimide), foams, foam material, of polyethylene and polyurethane, for example, foamed films, and creped and uncreped paper. Moreover, these materials may have been given a pretreatment and/or an aftertreatment. Common pretreatments are corona irradiation, impregnation, coating, painting, and hydrophobicization; customary aftertreatments are calendering, thermal conditioning, lamination, die cutting, and enveloping.

Low flammability in the carrier material and in the adhesive tape as a whole may be achieved by adding flame retardants to the carrier and/or to the adhesive. These retardants may be organobromine compounds, together where appropriate with synergists such as antimony trioxide; however, with a view to the absence of halogens from the adhesive tape, preference will be given to using red phosphorus, organophosphorus compounds, mineral compounds or intumescent compounds such as ammonium polyphosphate, alone or in conjunction with synergists.

As adhesives it is possible to use substantially all known adhesives possessing sufficient bond strength to the bond substrate that is to be packed.

The adhesive of the adhesive tape may be composed of an adhesive based on solventborne natural rubber adhesives and acrylic adhesives. Preference is given to adhesives based on acrylic dispersions; adhesives based on styrene-isoprene-styrene block copolymers are particularly preferred. These adhesive technologies are known and are used in the adhesive tape industry.

The coatweight of the adhesive on the carrier material is preferably from 15 to 60 g/m$^2$. In a further preferred embodiment, the coatweight set is from 20 to 30 g/m$^2$.

The adhesive tapes can be produced by known methods. An overview of customary production methods can be found, for example, in "Coating Equipment", Donatas Satas in Handbook of Pressure Sensitive Adhesive Technology, second edition, edited by Donatas Satas, Van Nostrand Reinhold New York pp. 767–808. The known methods of drying and slitting the adhesive tapes are likewise to be found in the Handbook of Pressure Sensitive Adhesive Technology, pp. 809–874.

A suitable adhesive composition is one based on acrylic hotmelt, having a K value of at least 20, in particular more than 30 (measured in each case in 1% strength by weight solution in toluene at 25° C.), obtainable by concentrating a solution of such a composition to give a system which can be processed as a hotmelt.

Concentrating may take place in appropriately equipped vessels or extruders; particularly in the case of accompanying devolatilization, a devolatilizing extruder is preferred.

An adhesive of this kind is set out in DE 43 13 008 C2. In an intermediate step, the solvent is removed completely from the acrylate compositions prepared in this way.

The K value is determined in particular in analogy to DIN 53 726.

In addition, further volatile constituents are removed. After coating from the melt, these compositions contain only small fractions of volatile constituents. Accordingly, it is possible to adopt all of the monomers/formulations claimed in the above-cited patent. A further advantage of the compositions described in the patent is that they have a high K value and thus a high molecular weight. The skilled worker is aware that systems with higher molecular weights may be crosslinked more efficiently. Accordingly, there is a corresponding reduction in the fraction of volatile constituents.

The solution of the composition may contain from 5 to 80% by weight, in particular from 30 to 70% by weight, of solvent.

It is preferred to use commercially customary solvents, especially low-boiling hydrocarbons, ketones, alcohols and/or esters.

Preference is further given to using single-screw, twin-screw or multiscrew extruders having one or, in particular, two or more devolatilizing units.

The adhesive based on acrylic hotmelt may contain copolymerized benzoin derivatives, such as benzoin acrylate or benzoin methacrylate, for example, acrylates or methacrylates. Benzoin derivatives of this kind are described in EP 0 578 151 A.

The adhesive based on acrylic hotmelt may be UV-crosslinked. Other types of crosslinking, however, are also possible, an example being electron beam crosslinking.

In one particularly preferred embodiment, self-adhesive compositions used comprise copolymers of (meth)acrylic acid and esters thereof having from 1 to 25 carbon atoms, maleic, fumaric and/or itaconic acid and/or esters thereof, substituted (meth)acrylamides, maleic anhydride, and other vinyl compounds, such as vinyl esters, especially vinyl acetate, vinyl alcohols and/or vinyl ethers.

The residual solvent content should be below 1% by weight.

It is also possible to use an adhesive from the group of the natural rubbers or the synthetic rubbers or any desired blend of natural and/or synthetic rubbers, the natural rubber or rubbers being selectable in principle from all available grades such as, for example, crepe, RSS, ADS, TSR or CV grades, depending on required purity and viscosity, and the synthetic rubber or rubbers being selectable from the group of randomly copolymerized styrene-butadiene rubbers (SBR), butadiene rubbers (BR), synthetic polyisoprenes (IR), butyl rubbers (IIR), halogenated butyl rubbers (XIIR), acrylic rubbers (ACM), ethylene-vinyl acetate (EVA) copolymers and polyurethanes and/or blends thereof.

Furthermore, and preferably, the processing properties of the rubbers may be improved by adding to them thermoplastic elastomers with a weight fraction of from 10 to 50% by weight, based on the total elastomer fraction.

As representatives, mention may be made at this point, in particular, of the particularly compatible styrene-isoprene-styrene (SIS) and styrene-butadiene-styrene (SBS) types.

As tackifying resins it is possible without exception to use all known tackifier resins which have been described in the literature. Representatives that may be mentioned include the rosins, their disproportionated, hydrogenated, polymerized, esterified derivatives and salts, the aliphatic and aromatic hydrocarbon resins, terpene resins, and terpene-phenolic resins. Any desired combinations of these and other resins may be used in order to adjust the properties of the resulting adhesive in accordance with what is desired. Explicit reference is made to the depiction of the state of the art in the "Handbook of Pressure Sensitive Adhesive Technology" by Donatas Satas (van Nostrand, 1989).

"Hydrocarbon resin" is a collective term for thermoplastic polymers which are colorless to intense brown in color and have a molar mass of generally <2000.

They may be divided into three main groups according to their provenance: petroleum resins, coal tar resins, and terpene resins. The most important coal tar resins are the coumarone-indene resins. The hydrocarbon resins are obtained by polymerizing the unsaturated compounds that can be isolated from the raw materials.

Included among the hydrocarbon resins are also polymers obtainable by polymerizing monomers such as styrene and/or by means of polycondensation (certain formaldehyde resins), with a correspondingly low molar mass. Hydrocarbon resins are products with a softening range that varies within wide limits from <0° C. (hydrocarbon resins liquid at 20° C.) to >200° C. and with a density of from about 0.9 to 1.2 g/cm$^3$.

They are soluble in organic solvents such as ethers, esters, ketones, and chlorinated hydrocarbons, and are insoluble in alcohols and water.

By rosin is meant a natural resin which is recovered from the crude resin from conifers. Three types of rosin are differentiated: balsam resin, as a distillation residue of turpentine oil; root resin, as the extract from conifer root stocks; and tall resin, the distillation residue of tall oil. The most significant in terms of quantity is balsam resin.

Rosin is a brittle, transparent product with a color ranging from red to brown. It is insoluble in water but soluble in many organic solvents such as (chlorinated) aliphatic and aromatic hydrocarbons, esters, ethers, and ketones, and also in plant oils and mineral oils. The softening point of rosin is situated within the range from approximately 70 to 80° C.

Rosin is a mixture of about 90% resin acids and 10% neutral substances (fatty acid esters, terpene alcohols, and hydrocarbons). The principal rosin acids are unsaturated carboxylic acids of empirical formula $C_{20}H_{30}O_2$, abietic, neoabietic, levopimaric, pimaric, isopimaric, and palustric acid, as well as hydrogenated and dehydrogenated abietic acid. The proportions of these acids vary depending on the provenance of the rosin.

Plasticizers which can be used are all plasticizing substances known from adhesive tape technology. They include, inter alia, the paraffinic and naphthenic oils, (functionalized) oligomers such as oligobutadienes and oligoisoprenes, liquid nitrile rubbers, liquid terpene resins, animal and vegetable oils and fats, phthalates, and functionalized acrylates.

For the purpose of heat-induced chemical crosslinking, it is possible to use all known heat-activatable chemical crosslinkers such as accelerated sulfur or sulfur donor systems, isocyanate systems, reactive melamine resins, formaldehyde resins, and (optionally halogenated) phenol-formaldehyde resins and/or reactive phenolic resin or diisocyanate crosslinking systems with the corresponding activators, epoxidized polyester resins and acrylic resins, and combinations thereof.

The crosslinkers are preferably activated at temperatures above 50° C., in particular at temperatures from 100° C. to 160° C., with very particular preference at temperatures from 110° C. to 140° C.

The thermal excitation of the crosslinkers may also be effected by means of IR rays or other high-energy electromagnetic alternating fields.

With reference to the figures described below, one particularly advantageous embodiment of the invention is illustrated, without wishing to be unnecessarily restricted by the choice of the figures shown.

BRIEF DESCRIPTION OF THE DRAWINGS

Accordingly, FIG. 1 shows a device in which an adhesive 8 is placed onto a substrate 7. That is, it shows a process for producing adhesive tapes.

Figure 1:
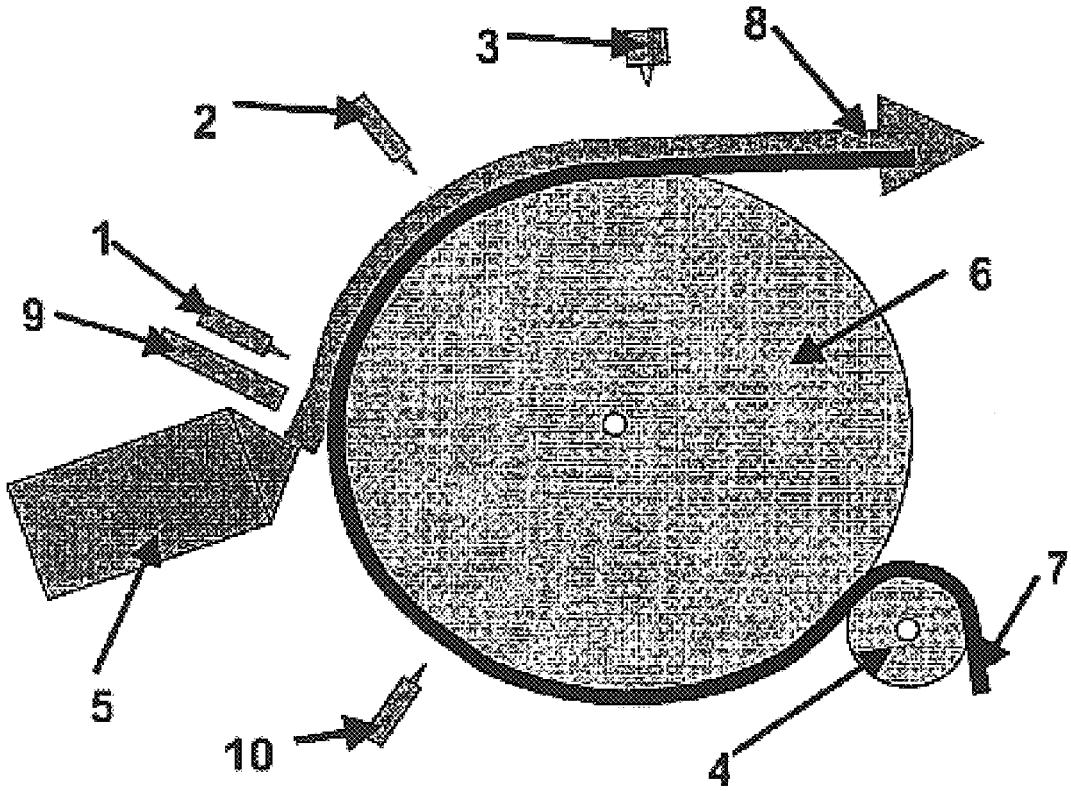
FIG. 1 shows the process of the invention in one particularly advantageous embodiment.

The device has a coating roller 6; in this case, a grounded chill roll is used. The substrate 7 is a release liner, consisting of a monoaxially oriented polypropylene film provided on both sides with anti-adhesive silicone layers.

The substrate 7 is placed onto the coating roller 6 via a contact roller 4, thereby removing the air between substrate 7 and coating roller 6. Then the final remaining air between substrate 7 and coating roller 6 is removed substantially by means of a substrate electrode 10 which is located between the contact roller 4 and the coating die 5.

Finally, via the coating die 5, the composition 8, in this case an adhesive, is applied, this operation being carried out under the lay-on electrode 1.

Here, with the lay-on electrode 1, electrons are applied to one side of the composition 8. Countercharges immediately develop on the surface of the coating roller 6. The resulting field causes a force to act on the composition plus substrate, this force pressing both layers onto the coating roller 6.

After it has traversed the countercharging electrode 2 and the discharge electrode 3, the substrate 7 coated with the composition 8 is removed from the coating roller 6.

The countercharging electrode 2 brings positive charges to the composition 8, the countercharges present so far on the surface flow off again, and the field largely collapses.

At the discharge electrode 3, finally, the last charges on the composition 8 are removed.

The baffle 9 upstream of the lay-on electrode 1 bounds the ion-enriched space.

Figure 2:
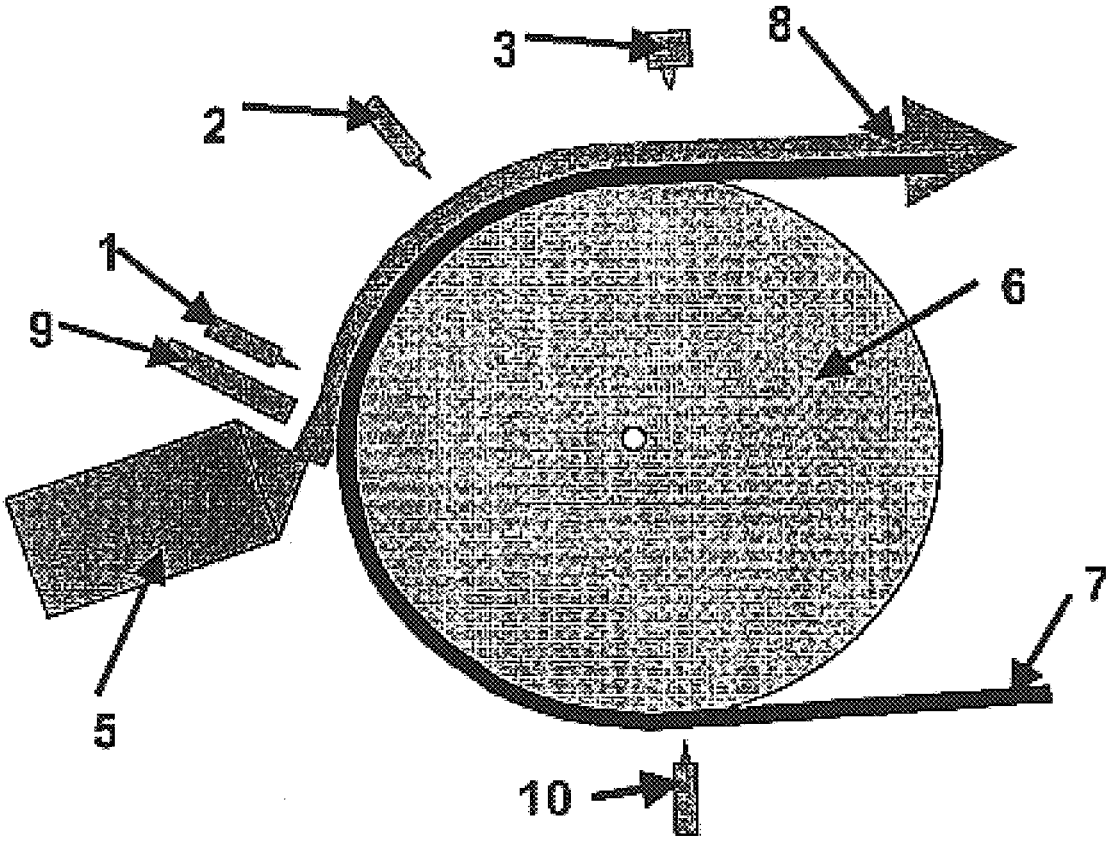
FIG. 2 shows the process of the invention in another particularly advantageous embodiment.

FIG. 2 largely corresponds to FIG. 1. The contact roller 4 for laying the substrate 7 onto the coating roller 6 is absent. In this case the laying of the substrate onto the coating roller 6 takes place by means of a substrate electrode 10 in the region above the coating line of the substrate 7 onto the coating roller 6, as a result of which the air between substrate 7 and coating roller 6 is removed in a particularly effective way.

EXAMPLES

Example 1

An acrylic adhesive was polymerized in solvents and concentrated in an extruder. In a further extruder, resins, aging inhibitors, and other additives were admixed. Coating of the composition took place via a melt pump through a slot die (from Extrusion Dies Inc., USA) with a coating width of 35 cm onto a polypropylene release film, 70 $\mu$m thick, with which the coating was laid using a contact roller onto a temperature-controllable coating roller. In a downstream laminating station, a BOPP film 50 $\mu$m thick was laminated onto the coated side of the first film, which had been provided on both sides with 0.5 g/m$^2$ anti-adhesive silicone layers. The laminate was then wound up. The coating roller in this case was equipped with a conductive, very smooth, polished chrome coat.

The composition layer was charged using a needle-type lay-on electrode (type R130A from Eltex) which was supplied with power from a high-voltage generator (type KNH34/N from Eltex). Additionally, a second, identical needle electrode (countercharging electrode) was mounted in the region between the coating line of the composition and the take-off line of the coated substrate from the coating roller and supplied with high voltage of opposite polarity from a further high-voltage generator (type KNH34/P from Eltex). With a web speed of 75 m/min, the lay-on electrode was charged with a negative high voltage of −15.8 kV. The distance of the needle tips from the roller surface, the position of the electrode in the running direction of the web, and the angle of inclination of the electrode to the tangent of the coating roller were optimized until bubbles were no longer observed between composition and substrate. At that point the needle distance was about 5 mm from the roller surface, the position of the electrode was about 8 mm behind the coating line in the running direction of the web, and the angle of inclination to the tangent of the coating roller was 90°.

The countercharging electrode was supplied with an opposite, i.e., positive, high voltage of +13.7 kV, so that the absolute value of the electrode current was equal to that of the lay-on electrode and the coated substrate was therefore electrostatically neutralized before departing the roller. The distance of the needle tips of the countercharging electrode from the roller surface was about 12 mm.

Over the detachment line of the web from the coating roller, however, an active discharge electrode (type R51A from Eltex) fed with 8 kV alternating current at a frequency of 50 Hz from a power supply (from Eltex, type ES52), was additionally provided.

At an application rate of 50 g/m$^2$, a coating speed of 85 m/min was achieved without bubbles being observable between composition and substrate.

The formation of bubbles was determined in line using a camcorder, a strong light source, and a monitor, with the aid of status pictures and exposure times of between 100 and 1000 microseconds, and also by the inspection of samples after the web had been halted.

Subsequently, a lay-on electrode (substrate electrode) was mounted in the region between the contact roller and the coating means over the coating roller. The substrate electrode (type R130A from Eltex) was charged with a positive high voltage of +8.7 kV. Accordingly, it had a polarity opposite to that of the lay-on electrode. Power supply was from a high-voltage generator (type KNH34/P from Eltex). The distance of the needle tips of the countercharging electrode from the surface of the roller was about 12 mm.

Owing to the positive charges applied to the substrate, it was possible to lower the high voltage at the lay-on electrode to 9.2 kV. There was also a possibility to reduce the high voltage of the countercharging electrode. Here, the high voltage was set so that the sum of the currents into the substrate electrode and into the countercharging electrode was equal to the absolute value of the current into the lay-on electrode. This was followed by a fine tuning procedure, so that only minimal charges were found on the coated substrate after departing the coating roller.

At an application rate of 50 g/m$^2$, with this arrangement a coating speed of 92 m/min was achieved without the observation of bubbles between composition and substrate. Additionally it was observed that the tendency of the MOPP release film to crease as a result of the heating caused by the laying-on of the hot composition, because of the firm adhesion to the coating roller, was markedly reduced because of the charging with the substrate electrode.

When the web speed was increased further, small bubbles were in evidence between the coating and the substrate, arranged around circles with a diameter of approximately 3–5 mm.

Example 2

It was assumed that the bubbles described in Example 1, arranged around circles, were caused by residual air remaining between coating roller and substrate. This assumption was made because the electrical field under the lay-on electrode is influenced by residual air bubbles. Additionally, the air in these residual air bubbles can be expected to be ionized, thereby not only influencing the electrical field lines to an even greater extent but also giving rise to the possibility of increased damage to the release layer.

In this experiment, the same setup as in Example 1 was chosen. The path of the web was modified, however, so that it did not pass around the contact roller. Instead, the substrate was pressed against the coating roller with the substrate electrode, which was arranged over the coating line. It was possible to choose the same voltage settings as in Example 1.

With the same application rate of 50 g/m as in Example 1, the maximum coating speed of 100 m/min was achieved on the experimental system with this arrangement, without any bubbles being observed between composition and substrate.

The small bubbles between coating and substrate arranged around circles of about 3 to 5 mm that were observed in Example 1 were no longer observed here.

In order to compare the damage to the release layers, specimens were also produced at 85 m/min and compared with the procedure in Example 1 with contact roller and without substrate electrode.

The damage was determined by the following measurement method.

Measurement of the Release Force

A double-sided test adhesive tape is applied without bubbles to that side of the release liner that is to be measured, and is pressed on by rolling over it five times with a 2 kg steel roller. The assembly is then stored in a hot chamber at 70° C. for one week. In order to measure the peel force (release force), the test tape side facing the release liner is fastened to a steel rail. The release liner bonded to the test adhesive tape is then peeled off at an angle of 180° and a speed of 300 mm/min. The tensile force (in cN/cm) required to achieve this is measured on a tensile testing machine under standardized conditions (23° C., 50% atmospheric humidity).

The values reported are the minimum, the maximum, and the average of five individual measurements.

Release forces measured by the method indicated

| | Minimum | Maximum | Average |
|---|---|---|---|
| Undamaged reference sample | 9 cN/cm | 12 cN/cm | 11 cN/cm |
| Open side of the release film with contact roller | 18 cN/cm | 30 cN/cm | 23 cN/cm |
| Hidden side of the release film with contact roller | 16 cN/cm | 22 cN/cm | 19 cN/cm |
| Open side of the release film with substrate electrode | 17 cN/cm | 24 cN/cm | 21 cN/cm |
| Hidden side of the release film with substrate electrode | 16 cN/cm | 20 cN/cm | 18 cN/cm |

The results show that primarily the maximum values for the release forces go down.

We claim:

1. A process for producing products in web form having at least two layers, which comprises applying an electrostatic charge to a substrate web on a transporting surface by a first electrode positioned above said substrate web on said transporting surface, applying a composition as a coating layer to said substrate with an electrostatic charge being applied to said composition, then electrostatically neutralizing the coated substrate with a second electrode prior to removing the coated substrate from the transporting surface.

2. The process of claim 1, wherein said composition is applied to said substrate through a die.

3. The process of claim 1, wherein said transporting surface is the surface of a contact roller.

4. The process of claim 3, wherein said contact roller is electrically grounded, temperature controlled or both.

5. The process of claim 1, wherein an electrostatic charge is applied to said composition by at least one third electrode positioned above the layer of composition on the substrate and proximate the locus where the layer of composition is applied to the substrate.

6. The process of claim 5, wherein said at least one third electrode positioned above the layer of composition on the substrate is two needle electrodes, spaced apart from each other in the direction of travel of said transporting surface by a distance equal to one-half the distance between the needles on said needle electrodes.

7. The process of claim 1, wherein said second electrode is positioned above the coated substrate between the locus where the layer of composition is applied to the substrate and the locus where the coated substrate is removed from the transporting surface.

8. The process of claim 7 wherein the electrostatic neutrality of said coated substrate is maintained by at least one fourth electrode positioned above the coated substrate proximate the locus where the coated substrate is removed from the transporting surface.

9. The process of claim 1 wherein said substrate is applied to said moving surface by a contact roller and said coated substrate is removed from said transporting surface by a take-off roller.

10. The process of claim 5, further comprising positioning an electrically-insulating baffle between said third electrode and the locus where the layer of composition is applied to the substrate.

11. The process of claim 1, wherein after the application of said electrostatic charge to said substrate by said first electrode and before the application of said coating layer to said substrate, said substrate is electrostatically neutralized.

12. The process of claim 3, wherein said coating roller is maintained at a voltage of from 1 to 40 kV.

13. The process of claim 12 wherein said voltage is from 2 to 15 kV.

14. The process of claim 1, wherein said coating layer is crosslinked before the coated substrate is removed from said transporting surface.

15. The process of claim 14, wherein said crosslinking is accomplished by exposure of said coating to electron beams, ultraviolet radiation, visible light, by heating or by any combination thereof.

16. The process of claim 1, wherein said first electrode comprises a plurality of electrodes arranged in series.

17. The process of claim 9, wherein said first electrode is between the situs of said contact roller and the situs where said composition is applied to said substrate.

18. The process of claim 1, wherein said substrate is placed onto said transporting surface at a first situs, said first electrode is positioned above said transporting surface at said first situs, and said electrostatic charge applied to said substrate by said first electrode presses said substrate to said transporting surface.

19. The process of claim 5, wherein said first and third electrodes are charged with electrical voltages of opposite polarity with respect to each other.

20. The process of claim 1, wherein said substrate is a carrier material for an adhesive tape, said composition is an adhesive, or both.

21. The process of claim 1, wherein said substrate is a release liner for an adhesive tape.

22. The process of claim 1, wherein said substrate comprises one or more layers, said coating comprises one or more layers and at least one of said layers is an adhesive.

23. The process of claim 1, wherein said substrate comprises a layer of release liner, a layer of adhesive and a layer of carrier for a double-sided adhesive tape.

24. The process of claim 1, wherein said substrate is a release liner and said coating comprises a first adhesive, a carrier and a second adhesive, said first adhesive, carrier and second adhesive being applied to said release liner by a triple-manifold die or an adapter die.

25. The process of claim 1, wherein said composition comprises an acrylic, natural rubber, synthetic rubber or ethylene vinyl acetate adhesive.

* * * * *